US006548218B1

(12) United States Patent
Kukimoto et al.

(10) Patent No.: US 6,548,218 B1
(45) **Date of Patent: *Apr. 15, 2003**

(54) MAGNETIC PARTICLES FOR CHARGING MEANS, AND ELECTROPHOTOGRAPHIC APPARATUS, PROCESS CARTRIDGE AND IMAGE FORMING METHOD INCLUDING SAME

(75) Inventors: Tsutomu Kukimoto, Yokohama (JP); Kenji Okado, Yokohama (JP); Shuichi Aita, Yokohama (JP); Tsuyoshi Takiguchi, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/492,445

(22) Filed: Jun. 19, 1995

(30) Foreign Application Priority Data

Jun. 22, 1994 (JP) ..... 6-140179

(51) Int. Cl.[7] ..... G03G 13/02; G03G 15/02

(52) U.S. Cl. ..... 430/120; 430/66; 430/67; 430/902; 399/159; 399/175; 361/226

(58) Field of Search ..... 361/225, 226; 355/219; 430/106.6, 108, 97, 902, 66, 67, 120; 252/62.56, 62.61; 399/175, 176

(56) References Cited

U.S. PATENT DOCUMENTS

| | | | | |
|---|---|---|---|---|
| 4,174,903 A | | 11/1979 | Snelling | |
| 4,282,302 A | * | 8/1981 | Makino et al. | 430/111 |
| 4,485,162 A | * | 11/1984 | Imamura et al. | 430/106.6 |

(List continued on next page.)

FOREIGN PATENT DOCUMENTS

| | | | | |
|---|---|---|---|---|
| EP | 0109860 | | 5/1984 | |
| EP | 0615177 | * | 9/1994 | 355/219 |
| JP | 63-149669 | | 6/1983 | |
| JP | 61-57958 | | 3/1986 | |

OTHER PUBLICATIONS

Patent Abst. of Japan, vol. 11, No. 29, (P–540) [2476] Jan. 1987.
Patent Abst. of Japan, vol. 7, No. 28, (P–231) [1383] Oct. 1983.
Patent Abst. of Japan, vol. 12, No. 192, (P–712) [3039] Jun. 1988.
Patent Abst. of Japan, vol. 8, No. 225, (C–247) Oct. 1984.
Patent Abst. of Japan, vol. 14, 148, (P–1024) Mar. 1990.
Grant, R. et al, ed. *Grant & Hach's Chemical Dictionary*, 5th ed, McGraw–Hill Book Company, (NY) (1987) pp. 86, 352, 556, 557.*

*Primary Examiner*—Janis L. Dote
(74) *Attorney, Agent, or Firm*—Fitzpatrick, Cella, Harper & Scinto

(57) ABSTRACT

Magnetic particles for charging means disposed in contact with an electrophotographic photosensitive member for charging the electrophotographic photosensitive member based on a voltage applied thereto are provided as particles of a ferrite component represented by the following formula (1):

$$(Fe_2O_3)_X(A)_Y(B)_Z \quad (1),$$

wherein A denotes at least one metal oxide component selected from the group consisting of $Li_2O$, MnO and MgO, B denotes at least one metal oxide component different from A; X, Y and Z denote numbers representing mol ratios and satisfying the following conditions: $0.2<X<0.95$, $0.01<Y<0.5$, $X+Y\leqq 1$, and $0\leqq Z<0.79$. The magnetic particles show an excellent charging performance, particularly in injection charging, without causing a difficulty, such as soiling or pinhole leakage of the photosensitive member.

8 Claims, 2 Drawing Sheets

U.S. PATENT DOCUMENTS 4,791,455 A * 12/1988 Yamamoto et al. ..... 430/125
4,851,960 A 7/1989 Nakamura et al. ..... 361/225
4,863,823 A * 9/1989 Hiro et al. ..... 430/67
5,342,718 A * 8/1994 Nousho et al. ..... 430/66
5,406,353 A * 4/1995 Asanae ..... 355/200
5,422,216 A * 6/1995 Smith et al. ..... 430/106.6
5,426,489 A * 6/1995 Haneda et al. ..... 355/219
5,455,135 A * 10/1995 Maruyama et al. ..... 430/67
5,466,552 A * 11/1995 Sato et al. ..... 430/106.6
5,606,401 A * 2/1997 Yano ..... 361/221
5,708,932 A * 1/1998 Yano et al. ..... 399/175
5,795,693 A * 8/1998 Okado et al. ..... 430/111.33
6,316,156 B1 * 11/2001 Takiguchi et al. ..... 430/111.33

* cited by examiner

MAGNETIC PARTICLES FOR CHARGING MEANS, AND ELECTROPHOTOGRAPHIC APPARATUS, PROCESS CARTRIDGE AND IMAGE FORMING METHOD INCLUDING SAME

FIELD OF THE INVENTION AND RELATED ART

The present invention relates to magnetic particles for charging means for charging an electrophotographic photosensitive member, and an electrophotographic apparatus, a process cartridge and an image forming method using the charging means.

Hitherto, a large number of electrophotographic processes have been known. In these processes, an electrostatic latent image is formed on a photosensitive member comprising a photoconductive material by charging means and imagewise exposure means, then the latent image is developed and visualized with a toner, and the resultant toner image is, after transferred onto a transfer-receiving material, such as paper, as desired, fixed by heating, pressing, heating and pressing, etc., to obtain a copy or a print. The residual toner remaining on the photosensitive member without being transferred is removed in a cleaning step. The above steps are repeated.

In recent years, various organic photoconductive substances have been developed as a photoconductive substance for electrophotographic photosensitive member, and accordingly a function separation-type photosensitive member including a lamination of a charge generation layer and a charge transport layer is commercialized and loaded on copying apparatus, printers, facsimile apparatus, etc. In such electrophotographic apparatus, corona discharge means have been conventionally used as charging means, but are accompanied with difficulties, such as occurrence of a large amount of ozone and a filter for removing the ozone, resulting in a size enlargement and an increase in running cost of the apparatus.

As a technical solution of such difficulties, a charging method for minimizing the occurrence of ozone has been developed, wherein a charging means, such as a roller or a blade is abutted to the photosensitive member surface to form a narrow gap in the proximity of the contact portion where a discharge appearing to follow the Paschen's law occurs. Among these, it is preferred to use a roller charging system using a charging roller as a charging means in view of the charging stability.

The charging is effected by discharge from the charging member to a charge-receiving member, so that the charging is started by application of a voltage exceeding a certain threshold. For example, in case of abutting a charging roller against a photosensitive member having a ca. 25 $\mu$m-thick photosensitive layer comprising an organic photoconductor, the surface potential of the photosensitive member is started to increase by application of a voltage of ca. 640 volts or above and thereafter increased linearly proportional to an applied electric field at a slope of 1. Hereinafter, the threshold voltage is defined as a charge initiation voltage Vth. In other words, in order to obtain a surface potential Vd on the photosensitive member, a larger DC voltage of Vd+Vth has to be applied to the charging roller. Further, the resistivity of the charging roller can vary corresponding to a change in environmental conditions, so that it has been difficult to control the potential of the photosensitive member at a desired value.

For this reason, in order to accomplish a further uniform charging, it has been proposed to use a DC+AC charging system of applying to a charging roller a voltage obtained by superposing an AC voltage having a peak-to-peak voltage of at least 2×Vth on a DC voltage corresponding to a desired Vd as disclosed in Japanese Laid-Open Patent Application (JP-A) 63-149669. This aims at taking advantage of a potential smoothening effect of the AC voltage, and the potential of the charge-receiving member is converged to a central value Vd of the AC voltage, which is less affected by a change in external conditions.

In the charging method (contact or proximity charging method) based on a charging mechanism utilizing a discharge from the charging member to the photosensitive member or charge-receiving member, it is still necessary to apply a charging voltage in excess of a required surface potential of the photosensitive member. Further, as a result of application of the AC electric field, new problems have occurred, such as the occurrence of vibration of the charging member and the photosensitive member and a noise accompanying the vibration (hereinafter referred to as "AC charging noise") and accelerated deterioration of the photosensitive member surface due to the discharge.

On the other hand, there has been known an image forming method wherein a photosensitive member having an electroconductive protective film is charged by using electroconductive fine particles as disclosed in JP-A 61-57958. The JP reference contains a description to the effect that a photosensitive member having a semiconductive protective film having a resistivity of $10^7$–$10^{13}$ ohm.cm can be charged uniformly, without irregularities and without causing charge-injection into the photosensitive layer by using electroconductive particles having a resistivity of at most $10^{10}$ ohm.cm, whereby good image reproduction can be accomplished. According to this method, it is possible to prevent occurrence of vibration and noise which have been problems in the AC charging, but the charging efficiency is low. Further, as the transfer residual toner on the photosensitive member is scraped by the conductive particles as the charging member, the toner is attached to the charging member, whereby the charging performance is liable to be changed.

Further, it has been desired to charge a photosensitive member by direct injection of charge.

So-called injection charging method of injecting a charge to a trap level at the surface of a photosensitive member by applying a voltage to a contact charging member, such as a charging roller, a charging fiber brush, or a charging magnetic brush has been reported in, e.g., Japan Hardcopy 92 Annual Paper Collection P. 287, "Contact Charging Performance by Using Electroconductive Roller" (in Japanese). According to the method, a photosensitive member which is insulating in the dark is subjected to injection charging by a low-resistivity charging member supplied with a voltage, so that the method essentially requires that the charging member has a sufficiently low resistivity and an electroconductivity-imparting substance (such as conductive filler) is sufficiently exposed to the surface. Accordingly, the above paper describes that the charging member preferably comprises an aluminum foil or an ion-conductive charging member having a sufficiently low resistivity in a high-humidity environment. According to our study, a charging member capable of effecting a sufficient charge injection to a photosensitive member may have a resistivity of at most $1\times10^3$ ohm.cm, above which a difference begins to occur between the applied voltage and the charge potential, so that the stability of charge potential is liable to be impaired.

However, when such a charging member having a low resistivity is actually used, an excessively large leakage current is liable to flow into scars or pinholes formed at the photosensitive member surface, several difficulties are caused, such as insufficient charging in the neighborhood, enlargement of the pinholes and conduction breakdown of the charging member.

In order to prevent these problems, it is necessary to provide a resistivity on the order of at least $1\times10^4$ ohm.cm to the charging member. At this level of resistivity, however, the charge injection performance into the photosensitive member is lowered, so that the effective charging cannot be performed. This is a contradiction.

Accordingly, it has been desired to solve the above-mentioned problems in a contact-type charging device or an image forming method using such a charging device. More specifically, it has been desired to satisfy in combination a good charging performance by charge injection which cannot have been accomplished without using a low-resistivity charging member and prevention of pinhole leakage on the charge-receiving member which cannot have been accomplished by using such a low-resistivity charging member.

Further, in an image forming method using a charging member contacting a charge-receiving member, the charging member is liable to be soiled (by toner melt-sticking) to cause a charging failure leading to image defects and is thus liable to cause a problem in successive image forming performance. Also in the method of directly injecting charge into a charge-receiving member, it is an urgent problem to be solved for allowing image formation on a large number of sheets to prevent the soiling of the charging member causing charging failure.

SUMMARY OF THE INVENTION

An object of the present invention is to provide magnetic particles for charging means, less liable to be soiled and capable of retaining a good charging performance for a long period.

Another object of the present invention is to provide magnetic particle for charging means, capable of showing a good injection charging performance.

According to the present invention, there is provided magnetic particles for charging means disposed in contact with an electrophotographic photosensitive member for charging the electrophotographic photosensitive member based on a voltage applied thereto, comprising a ferrite component represented by the following formula (1):

$$(Fe_2O_3)_X(A)_Y(B)_Z \quad (1),$$

wherein A denotes at least one metal oxide component selected from the group consisting of $Li_2O$, MnO and MgO, B denotes at least one metal oxide component different from A; X, Y and Z denote numbers representing mol ratios and satisfying the following conditions: $0.2<X<0.95$, $0.01<Y<0.5$, $X+Y\leqq1$, and $0\leqq Z<0.79$.

According to another aspect of the present invention, there is provided an electrophotographic apparatus, comprising: an electrophotographic photosensitive member, and charging means, imagewise exposure means and developing means disposed in this order opposite to the photosensitive member, wherein said charging means includes a charging member comprising the above-mentioned magnetic particles and disposed contactable to the photosensitive member so as to charge the photosensitive member based on a voltage received thereby.

According to a further aspect of the present invention, there is provided a process cartridge, comprising: an electrophotographic photosensitive member, charging means, and, at least one member selected from developing means and cleaning means disposed, wherein said charging means includes a charging member comprising the above-mentioned magnetic particles and disposed contactable to the photosensitive member so as to charge the photosensitive member based on a voltage received thereby, and said electrophotographic photosensitive member, charging means and at least one member selected from developing means and cleaning means are integrally supported to form a cartridge which is detachably mountable to an electrophotographic apparatus main body.

According to a still further aspect of the present invention, there is provided an image forming method, comprising the steps of:

charging an electrophotographic photosensitive member by applying a voltage to a charging member comprising the above-mentioned magnetic particles and disposed in contact with the photosensitive member, imagewise exposing the charged photosensitive member to form an electrostatic image on the photosensitive member, and developing the electrostatic image.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
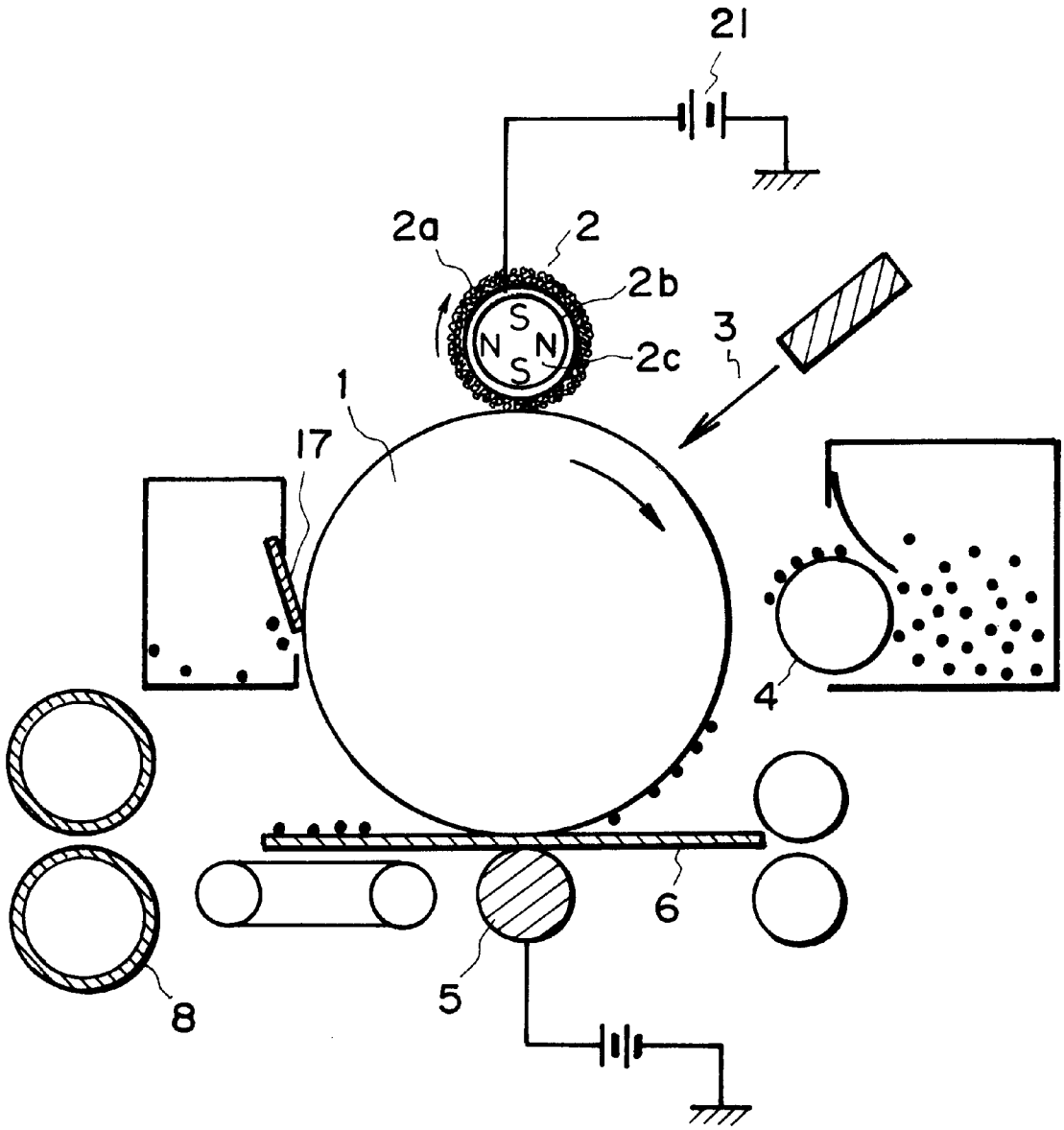
FIG. 1 is a schematic illustration of an embodiment of the image forming apparatus according to the present invention.

FIG. 1 is a schematic illustration of an embodiment of the image forming apparatus according to the present invention.

Referring to FIG. 1, an electrophotographic printer as an embodiment of the image forming apparatus includes an electrophotographic photosensitive member (photosensitive drum) rotating in the direction of an arrow, and further includes a charging member 2, imagewise exposure means 3, developing means 4, transfer means and cleaning means 17 disposed in this order opposite to the photosensitive member 1 so as to surround the photosensitive member 1.

As will be described in more detail, in a preferred embodiment, the photosensitive member 1 has a charge-injection layer as a surface layer.

The charging member 2 comprises magnetic particles 2*a* which are formed into magnetic brush or ears erected under the action of a magnetic field exerted by a magnet roller 2*c* enclosed within a non-magnetic sleeve 2*b* and is supplied with a voltage from a power supply 21.

More specifically, in the present invention, the magnetic particles are erected in the form of ears on the sleeve 2*b* to form as a whole a magnetic brush 2*a*, which is caused to contact and charge the photosensitive member 1 based on a voltage supplied to the charging member 2. Accordingly, the magnetic particles are required to have relatively strong magnetic properties. However, when such magnetic particles are used as they are, the resultant magnet brush is not readily provided with a volume resistivity in a preferred range for the charging member, so that the volume resistivity thereof may be adjusted through reduction and compositional modification.

The ferrite component constituting the magnetic particles according to the present invention has a modified composition from the above viewpoint represented by the formula (1):

$$(Fe_2O_3)_X(A)_Y(B)_Z \quad (1),$$

wherein A denotes at least one metal oxide component selected from the group consisting of $Li_2O$, MnO and MgO, B denotes at least one metal oxide component different from A; X, Y and Z denote numbers representing mol ratios and satisfying the following conditions: $0.2<X<0.95$, $0.01<Y<0.5$, $X+Y\leqq 1$, and $0\leqq Z<0.79$.

From the above viewpoint, it is preferred that the metal oxide component B comprises at least one metal oxide component selected from the group consisting of $Na_2O$, $K_2O$, CaO, SrO, $Al_2O_3$, $SiO_2$and $Bi_2O_3$. It is further preferred that the metal oxide component B is an oxide of an alkali metal or an alkaline earth metal providing a rather stable cation. That is, it is preferred to use at least one metal oxide component selected from the group consisting of $Na_2O$, $K_2O$, CaO and SrO. The reason therefor has not been fully clarified as yet but may be considered as follows. That is, in order to provide a ferrite in a spinel structure, it is important for a metal cation to have a proper ionic radius. For this reason, it is assumed that a ferrite including an oxide of Na, K, Ca or Sr in a solid solution form provides magnetic particles showing good performances.

In the present invention, if X, Y and Z do not satisfy the conditions of $0.2<X<0.95$, $0.01<Y<0.5$and $X+Y\leqq 1$, it becomes difficult to control the resistivity of the magnetic particles. From the productivity through sintering of the magnetic particles, $Y>Z$ is further preferred.

The charging member (magnetic brush) constituted by the magnetic particles according to the present invention may preferably have a resistance of $1\times10^4$–$1\times10^{11}$ ohm. If the resistance is below $1\times10^4$ ohm, a pinhole is liable occur in the photosensitive member. Above $1\times10^{11}$ ohm. is liable to hinder effective charging. In order to control the resistance within the above described range, the magnetic particles according to the present invention may preferably have a volume resistivity in the range of $1\times10^4$–$1\times10^{11}$ ohm.cm.

Particularly, in the case of using the magnetic particles to constitute a charging member (magnetic brush) 2 for injection charging of a photosensitive member 1, the charging member 2 has to satisfy, in combination, a function of satisfactorily injecting charge into the charge injection layer of the photosensitive member 1 and a function of preventing conduction breakdown of the charging member and the photosensitive member caused by concentration of a charging current at defects, such as pinholes formed in the photosensitive member. Accordingly, the charging member may preferably have a resistance of $1\times10^4$–$1\times10^9$ ohm, particularly $1\times10^4$–$1\times10^7$ ohm. Below $1\times10^4$ ohm, the pinhole leakage is liable to occur. Above $1\times10^9$ ohm, a satisfactory charging is liable to be hindered. In order to provide a resistance in the above-mentioned range to the charging member 2, the magnetic particles constituting the charging member should have a volume resistivity in the range of $10^4$–$10^9$ ohm.cm, preferably $10^4$–$10^7$ ohm.cm.

Further, in the case of contact charging other than the injection charging, the charging member may preferably have a resistance of $1\times10^6$–$1\times10^{11}$ ohm and correspondingly, the magnetic particles may preferably have a volume resistivity of $1\times10^6$–$1\times10^{11}$ ohm.cm.

In the present invention, for the purpose of controlling the volume resistivity, etc., it is sometimes preferred to surface-coat the magnetic particles with a resinous layer containing electroconductive particles, such as electroconductive metal oxide particles or carbon black, or a layer of an inorganic such as an electroconductive or semiconductive metal oxide at a coating rate of, e.g., 0.5–20 wt. % of the magnetic particles.

Incidentally, the volume resistivity values of magnetic particles described herein are based on values measured in the following manner.

Figure 2:
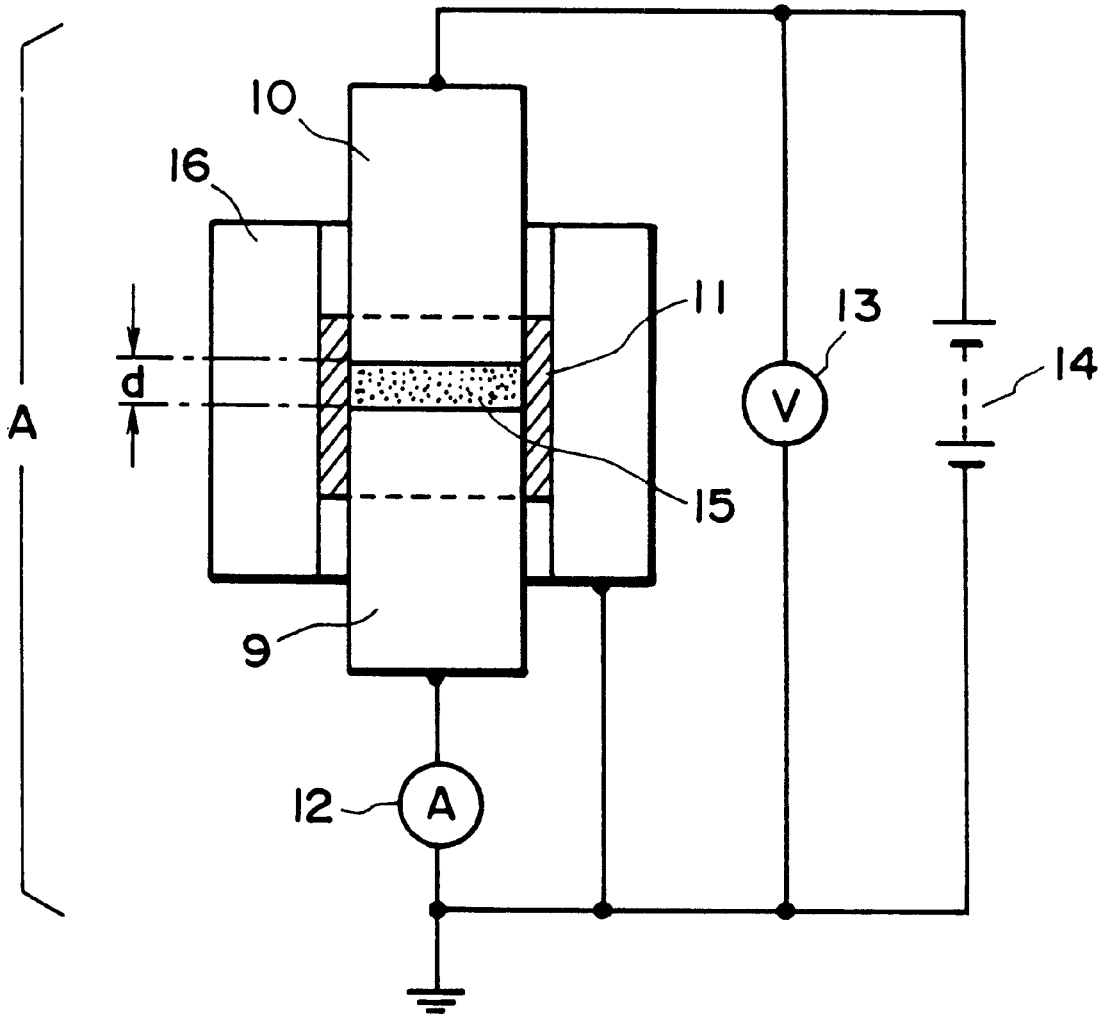
FIG. 2 is a schematic illustration of an apparatus for measuring the volume resistivity of magnetic particles suitably used in the present invention.

A cell A as shown in FIG. 2 is used. Into the cell A having a sectional area S (=2 $cm^2$) and held in a guide ring 16 via an insulating material 11, magnetic particles 15 are placed, and a principal electrode 9 and an upper electrode 10 are disposed to sandwich the magnetic particles 15 in a thickness d (=1 mm), under a load of 10 kg. Under this state, a voltage of 100volts supplied from a constant voltage supply 14 and measured by a volt meter 13 is applied, and a current passing through the sample magnetic particles 15 is measured by an ammeter 12 in an environment of 23° C. and 65%.

The magnetic particles according to the present invention may preferably have an average particle size and a mode particle size (peak particle size) both in the range of 5–100 $\mu$m from the viewpoint of preventing deterioration in charging performance due to soiling of the particle surface. Such a relatively small particle size is effective for increasing the specific surface area of the magnetic particles, providing a magnetic brush having a high density and promoting displacement of the magnetic particles, thereby providing a stable charging performance even if the surface is partially soiled.

More specifically, in case of using a charging magnetic brush composed of magnetic particles, e.g., iron powder, ferrite powder or powder of an iron oxide such as magnetite, as a charging member, it is possible to adjust the resistance of the charging member in the range of $1\times10^4$–$1\times10^9$ ohm but melt-sticking of toner onto the charging member is liable to occur, e.g., due to scraping of residual toner remaining on the photosensitive member without being cleaned after a successive image formation. In contrast thereto, if magnetic particles of a minute particle size are used, the adverse effect of toner melt-sticking (spent toner) can be alleviated due to an increase in specific surface area and an increase in density of the magnetic brush, but this leads to an inferior flowability of the magnetic particles and a difficulty of displacement of magnetic particles, so that it is not desirable a long period use of the magnetic particles. For this reason, in the present invention, it is preferred to use magnetic particles of a specific metal oxide composition having a good charging performance and having a relatively small particle size of 5–100 $\mu$m so as to retain a stable charging performance. An average particle size of 10–50 $\mu$m is further preferred. In other words, the volume resistivity of magnetic particles as a whole is retained within the above-described range and the ferrite having the specific metal oxide composition is used so as to avoid a deterioration in charging performance even when the toner melt-sticking occurs on the magnetic particles.

If the average particle size of the magnetic particles is below 5 $\mu$m, the attachment of magnetic brush onto the photosensitive member is liable to occur and, above 100 $\mu$m, it is liable that an increase in density of erected ears of magnetic brush on the sleeve becomes difficult, thus tending to provide an inferior performance of charging the photosensitive member.

Incidentally, the average particle size may be determined as an average of maximum axial lengths in horizontal direction of 100 particles selected at random by observation through an optical microscope or a scanning electron microscope.

Further, the mode (peak) particle size in particle size distribution may be determined through measurement by using a laser diffraction-type particle size distribution meter ("HEROS", available from Nippon Denshi K.K.) in a range of 0.05–200 $\mu$m divided into 32 fractions on a logarithmic scale.

Further, the magnetic particles according to the present invention may preferably have a saturation magnetization $\sigma_S$ of at least 40 $Am^2$/kg (emu/g) as measured under an external magnetic field of 487.9 kA/m (5000 oersted) so as to form a magnetic brush capable of showing a good charging performance. The magnetic properties are based on values measured by using a vibration-type magnetometer ("VSM-3S-15", available from Toei Kogyo K.K.).

In the present invention, the ferrite component constituting the magnetic particles according to the present invention can contain preferably at most 3 wt. % thereof of another metal component in the form of a hydroxide, oxide, sulfide or aliphatic acid compound. Accordingly, X+Y<1 in the formula (1) of the ferrite component means the case where the ferrite component contains such another optional component in an amount of preferably up to 3 wt. %.

A preferred embodiment of the photosensitive member will now be described, wherein the following layers may be included preferably in an order appearing hereinafter.

An electroconductive support is generally used, which may comprise a metal, such as aluminum or stainless steel, a plastic coated with a layer of aluminum alloy or indium oxide-tin oxide alloy, paper or a plastic sheet impregnated with electroconductive particles, or a plastic comprising an electroconductive polymer in a shape of a cylinder or a sheet.

On the electroconductive support, it is possible to dispose an undercoating layer for the purpose of providing an improved adhesion and applicability of the photosensitive layer, protection of the support, coverage of defects on the support, an improved charge injection from the support, and protection of the photosensitive layer from electrical breakage. The undercoating layer may comprise polyvinyl alcohol, poly-N-vinylimidazole, polyethylene oxide, ethyl cellulose, methyl cellulose, nitrocellulose, ethylene-acrylic acid copolymer, polyvinyl butyral, phenolic resin, casein, polyamide, copolymer nylon, glue, gelatin, polyurethane, or aluminum oxide. The thickness may ordinarily be ca. 0.1–3 $\mu$m.

A charge generation layer may comprise a charge generation substance, examples of which may include: organic substances, such as azo pigments, phthalocyanine pigments, indigo pigments, perylene pigments, polycyclic quinone pigments, pyrylium salts, thiopyrilium salts, and triphenylmethane dyes; and inorganic substances, such as selenium and amorphous silicon, in the form of a dispersion in a film of an appropriate binder resin or a vapor deposition film thereof. The binder resin may be selected from a wide variety of resins, examples of which may include polycarbonate resin, polyester resin, polyvinyl butyral resin, polystyrene resin, acrylic resin, methacrylic resin, phenolic resin, silicone resin, epoxy resin, and vinyl acetate resin. The binder resin may be contained in an amount of at most 80 wt. %, preferably 0–40 wt. %, of the charge generation layer. The charge generation layer may preferably have a thickness of at most 5 $\mu$m, preferably 0.05–2 $\mu$m.

A charge transport layer has a function of receiving charge carriers from the charge generation layer and transporting the carriers under an electric field. The charge transport layer may be formed by dissolving a charge transporting substance optionally together with a binder resin in an appropriate solvent to form a coating liquid and applying the coating liquid. The thickness may ordinarily be 0.5–40 $\mu$m. Examples of the charge transporting substance may include: polycyclic aromatic compounds having in then main chain or side chain a structure such as biphenylene, anthracene, pyrene or phenanthrene; nitrogen-containing cyclic compounds, such as indole, carbazole, oxadiazole, and pyrazoline; hydrazones, styryl compounds, selenium, selenium-tellurium, amorphous silicon and cadmium sulfide.

Examples of the binder resin for dissolving or dipersing therein the charge transporting substance may include: resins, such as polycarbonate resin, polyester resin, polystyrene resin, acrylic resins, and polyamide resins; and organic photoconductive polymers, such as poly-N-vinylcarbozole and polyvinyl-anthracene.

In case where the magnetic particles according to the present invention are used for injection charging, it is preferred to use a photosensitive member having a charge-injection layer as a layer most distant from the support, i.e., a surface layer. The charge-injection layer may preferably have a volume resistivity of $1\times10^8$ ohm.cm–$1\times10^{15}$ ohm.cm so as to have a sufficient chargeability and avoid image flow. It is particularly preferred to have a volume resistivity of $1\times10^{10}$ ohm.cm–$1\times10^{15}$ ohm.cm, in order to avoid the image flow, further preferably $1\times10^{12}$–$1\times10^{15}$ ohm.cm in view of environmental change. Below $1\times10^8$ ohm.cm, charge carrier is not retained along the surface in a high-humidity environment, thus being liable to cause image flow. Above $1\times10^{15}$ ohm.cm, charge cannot be sufficiently injected from the charging member and retained, thus being liable to cause a charging failure. By disposing a functional layer at the photosensitive member surface, charge injected from the charging member is retained therein, and further the change is allowed to flow to the support of the photosensitive member at the time of light exposure to reduce the residual potential. Further, by using the charging member and the photosensitive member according to the present invention, the charge initiation voltage Vth can be lowered and the photosensitive member charge potential can be, converged to a value which is almost 90% or above the applied voltage to the charging member.

For example, under ordinary charging condition (e.g., under application of a DC voltage of 100–2000 volts and a process speed of at most 1000 mm/min), it has become possible to effect an injection charging such that the photosensitive member having a charge-injection layer is charged to a potential which is at least 80%, preferably at least 90%, of a voltage applied to the charging member. This is a substantially larger value than, e.g., ca. 30%, i.e., a potential of ca. 200 volts in response to an applied DC voltage of 700 volts, in the case of conventional contact charging based on discharging.

The volume resistivity values of the charge injection layer described herein are based on values measured in the following manner used for measuring the volume resistivity of a surface layer-forming material. That is, a charge injection layer is formed on a conductive film (Au)-deposited PET film and subjected to measurement of a volume resistivity by using a volume resistivity measurement apparatus ("4140B pAMATER", available from Hewlett-Packard Co.) under application of a voltage of 100 volts in an environment of 23° C. and 65% RH.

The charge injection layer may be formed as an inorganic layer, such as a metal vapor-deposition layer, or a resin layer containing electroconductive particles dispersed therein. Such an inorganic layer may be formed by vapor deposition, and a conductive particles-dispersed resin layer may be formed by an appropriate coating method, such as dipping, spraying, roller coating or beam coating. Further, the charge injection layer can also be formed with a mixture or copolymer of an insulating binder resin and a light-transmissive resin having a high ion-conductivity, or a photoconductive resin having a medium resistivity alone. In order to constitute the conductive particle-dispersed resin layer, the electroconductive particles may preferably be added in an amount of 2–190 wt. % of the binder resin. Below 2 wt. %, a desired volume resistivity cannot be readily obtained and, above 190 wt. %, the charge injection layer is caused to have a lower film strength and is therefore liable to be worn out by scraping, thus resulting in a short life of the photosensitive member.

The charge injection layer may comprise a binder resin, examples of which may include; polyester, polycarbonate, acrylic resin, epoxy resin, phenolic resin, and curing agents of these resins. These may be used singly or in combination of two or more species. Further, in case of dispersing a large amount of electroconductive particles, it is preferred to use a reactive monomer or reactive oligomer with electroconductive particles dispersed therein and, after application thereof onto the photosensitive member surface, cure the applied resin under exposure to light or heat. Further, in case where the photosensitive layer comprises amorphous silicon, it is preferred to dispose a charge injection layer comprising SiC.

The electroconductive particles dispersed in the binder resin of the charge injection layer may for example comprise a metal or a metal oxide. It is preferred to use ultra-fine particles of zinc oxide, titanium oxide, tin oxide, antimony oxide, indium oxide, bismuth oxide, tin oxide-coated titanium oxide, tin-coated indium oxide, antimony-coated tin oxide, and zirconium oxide. These may be used singly or in combination of two or more species. In the case of dispersing particles in the charge injection layer, the particles are required to have a particle size which is smaller than the wavelength of light incident thereto, so as to avoid scattering of the incident light width the dispersed particles. Accordingly, the electroconductive particles, and other particles, if any, dispersed in the protective layer may preferably have a particle size of at most 0.5 μm.

The charge injection layer may preferably further contain lubricant particles, so that a contact (charging) nip between the photosensitive member and the charging member at the time of charging becomes enlarged thereby due to a lowered friction therebetween, thus providing an improved charging performance. The lubricant powder may preferably comprise a fluorine-containing resin, silicone resin or polyolefin resin having a low critical surface tension. Polytetrafluoroethylene (PTFE) resin is further preferred. In this instance, the lubricant powder may be added in 2–50 wt. %, preferably 5–40 wt. %, of the binder resin. Below 2 wt. %, the lubricant is insufficient, so that the improvement in charging performance is insufficient. Above 50 wt. %, the image resolution and the sensitivity of the photosensitive member are remarkably lowered.

The charge injection layer may preferably have a thickness of 0.1–10 μm, particularly 1–7 μm.

Hereinbelow, some Production Examples are presented for illustrating structure and materials of member used.

[Toner Production Example]

| | |
|---|---|
| Styrene/butyl methacrylate copolymer (copolymerization wt. ratio = 80/20) | 100 wt. parts(s) |
| Magnetite | 100 wt. parts(s) |
| Metal-containing azo pigment | 2 wt. parts(s) |
| Low-molecular weight polypropylene | 3 wt. parts(s) |

The above ingredients were blended in a Henschel mixer and melt-kneaded through an extruder set at 130° C. After being cooled, the melt-kneaded product was coarsely crushed by a cutting mill, finely pulverized by a jet mill using a jet stream and pneumatically classified to obtain black powder (magnetic toner particles) having a weight-average particle size of 7 μm. To 100 wt. parts of the black powder, 1.2 wt. parts of silica hydrophobized (i.e., hydrophobicity-imparted) with silicone oil, and the resultant mixture was blended by a Henschel mixer to obtain a magnetic toner.

[Photosensitive member Production Example 1]

An OPC-type negatively chargeable photosensitive member was prepared by disposing the following 5 layers about a 30 mm-dia. aluminum cylinder.

A first layer was a ca. 20 μm-thick electroconductive particle-dispersed resin layer (electroconductive layer) for smoothening defects on the aluminum cylinder and preventing occurrence of moire due to reflection of exposure laser light.

A second layer was a positive charge injection-preventing layer (undercoating layer) for preventing positive charge injection from the aluminum support from diminishing negative charge provided to the photosensitive member surface and formed as a ca. 1 μm-thick layer with a medium level resistivity of ca. $10^6$ ohm.cm. with 6-66-610-12-nylon and methoxymethylated nylon.

A third layer was a ca. 0.3 μm-thick charge generation layer comprising a disazo pigment dispersed in a resin and functional to generate positive and negative charge pairs when exposed to laser light.

A fourth layer was a ca. 25 μm-thick charge-transport layer comprising hydrazone dispersed in polycarbonate resin so as to form a p-type semiconductor. Accordingly, a negative charge formed on the photosensitive member surface could not move through this layer so that positive charge generated in the charge generation layer alone was transported to the photosensitive member surface.

A fifth layer was a charge injection layer, which comprised 100 wt. parts of a photocurable acrylic resin, 160 wt. parts of ca. 0.03 μm-dia. $SnO_2$ particles provided with a lower resistivity in an oxygen-short or -lacking form, 30 wt. parts of 0.25 μm-dia. tetrafluoroethylene resin particles for providing an increased contact time, and 1.2 wt. % of a dispersant.

The charge injection layer was formed in a thickness of ca. 3 μm by spray coating of a liquid containing the above materials.

As a result, the volume resistivity of the photosensitive member surface layer was lowered to $5\times10^{12}$ ohm.cm in contrast with $5\times10^{15}$ ohm.cm in case of the charge transport layer alone.

[Photosensitive member Production Example 2]

A photosensitive member was prepared in the same manner as in Production Example 1 except that the fifth layer was formed without using any of the tetrafluoroethylene resin particles and the dispersant.

As a result, the volume resistivity of the photosensitive member surface layer was lowered to $2\times10^{12}$ ohm.cm.

[Photosensitive member Production Example 3]

A photosensitive member was prepared in the same manner as in Production Example 1 except that the fifth layer was formed by dispersing 300 wt. parts of the ca. 0.03 μm-dia. $SnO_2$ particles in 100 wt. parts of photocurable acrylic resin.

The volume resistivity of the surface layer was $4\times10^7$ ohm.cm.

[Photosensitive member Production Example 4]

A photosensitive member was prepared in the same manner as in Production Example 1 except for omitting the fifth layer.

[Magnetic particle Production Example 1]

Magnetic particles comprising Mn-Sr ferrite particles (X=0.7, Y=0.26 and Z=0.04, A: MnO, B: SrO in the formula (1)) having an average particle size of 20 μm and a volume resistivity adjusted to $4\times10^6$ ohm.cm by reduction in a hydrogen atmosphere, were used as a charging member.

More specifically, for production of the ferrite particles, the respective metal oxide starting materials were weighed and blended, and the blended powder was calcined at ca. 900° C., followed by pulverization, to provide ferrite particles having an average particle size of ca. 2.0 μm (as measured by the air permeation method). Then, the pulverized powder was mixed with an aqueous solution of PVA (polyvinyl alcohol) containing PVA in an amount of 0.5–5.0 wt. % to form size-enlarged particles. The enlarged particles were then calcined at 1100–1300° C., disintegrated and classified into magnetic particle having a desired particle size.

[Magnetic particle Production Example 2]

Magnetic particles for charging member comprising Mn-Na ferrite particles (X=0.7, Y=0.22, Z=0.08, A: MnO, B: $Na_2O$ in formula (1)) having an average particle size of 30 μm and a volume resistivity of $3\times10^6$ ohm.cm were prepared in a similar manner as in Production Example 1 except for changing the metal oxide starting materials.

[Magnetic particle Production Example 3]

Magnetic particles for charging member comprising Mn-K ferrite particles (X=0.7, Y=0.24, Z=0.06, A: MnO, B: $K_2O$ in formula (1)) having an average particle size of 40 μm and a volume resistivity of $3\times10^6$ ohm.cm were prepared in a similar manner as in Production Example 1 except for changing the metal oxide starting materials.

[Magnetic particle Production Example 4]

Magnetic particles for charging member comprising Mn-Mg ferrite particles (X=0.7, Y=0.3, z=0, A: MnO and MgO in formula (1)) having an average particle size of 60 μm and a volume resistivity of $9\times10^5$ ohm.cm were prepared in a similar manner as in Production Example 1 except for changing the metal oxide starting materials.

[Magnetic particle Production Example 5]

Magnetic particles for charging member comprising Mn-Li-Bi ferrite particles (X=0.7, Y=0.28, Z=0.02, A: MnO and $Li_2O$, B: $Bi_2O_3$ in formula (1)) having an average particle size of 55 μm and a volume resistivity of $5\times10^6$ ohm.cm were prepared in a similar manner as in Production Example 1 except for changing the metal oxide starting materials.

[Magnetic particle Production Example 6]

Magnetic particles for charging member comprising Mn-Ca ferrite particles (X=0.7, Y=0.25, Z=0.05, A: MnO, B: CaO in formula (1)) having an average particle size of 40 μm and a volume resistivity of $6\times10^6$ ohm.cm were prepared in a similar manner as in Production Example 1 except for changing the metal oxide starting materials.

[Magnetic particle Production Example 7]

Magnetic particles for charging member comprising Ba ferrite particles (X=0.7, Y=0, Z=0.3, B: BaO in formula (1)) having an average particle size of 60 μm and a volume resistivity of $5\times10^9$ ohm.cm were prepared in a similar manner as in Production Example 1 except for changing the metal oxide starting materials.

[Magnetic particle Production Example 8]

Magnetic particles for charging member comprising magnetite particles (X=0.7, Y=0, Z=0.3, B: $Fe_2O_3$ in formula (1)) having an average particle size of 60 μm and a volume resistivity of $4\times10^3$ ohm.cm were prepared in a similar manner as in Production Example 1 except for changing the metal oxide starting materials.

[Magnetic particle Production Example 9]

Magnetic particles for charging member comprising Mn-Ca ferrite particles having an average particle size of 40 μm and a volume resistivity of $2\times10^8$ ohm.cm were prepared in a similar manner as in Production Example 6 except for omitting the hydrogen reduction treatment.

[Magnetic particle Production Example 10]

1 wt. part of straight silicone resin and 0.050 wt. part of electroconductive carbon black were dissolved or dispersed in 16 wt. parts of xylene and the mixture was subjected to 2 hours of dispersion in a paint shaker. The coating layer provided a surface layer showing a volume resistivity of $8\times10^6$ ohm.cm as measured in a similar as the measurement for a charge injection layer described above.

Then, the coating liquid was used for coating 200 wt. parts of the hydrogen-reduced Mn-Sr ferrite particles prepared in Production Example 1 by using a fluidized bed-type coating apparatus "SPIRACOATER", mfd. by Okada Seisakusho K.K. dried and further heated at 120° C. to provide coated magnetic particles showing a volume resistivity of $7\times10^6$ ohm.cm.

All the magnetic particles prepared in the above Production Examples respectively showed a saturation magnetization $\sigma_2$ of at least 45 $Am^2/kg$ (emu/g) under an external magnetic field of 487.9 kA/m (5000 oersted).

EXAMPLE 1

A photosensitive member and a contact charging member as described above may be used for charging in principle as follows. According to the present invention, a charging member having a medium level of resistance is used to inject charge to the surface of a photosensitive member having a medium level surface resistivity. In this embodiment, a charge is not injected to a trap potential level of the photosensitive member but is injected to charge the electroconductive particles in the charge injection layer to charge the photosensitive member as a whole.

More specifically, a charge is stored in a minute capacitor functionally formed by a charge transport layer functioning as a dielectric layer, and an aluminum support and a layer of electroconductive particles in the charge injection layer functioning as two electrode plates. In this instance, the electroconductive particles are electrically independent from each other, and each constitute a minute floating electrode. As a result, the photosensitive member surface appears to be macroscopically uniformly charged, but actually an enormous number of charged electroconductive particles cover the photosensitive member surface. Therefore, when image-wise exposure is performed by laser scanning, an electrostatic latent image can be retained because individual electroconductive particles are electrically independent.

In a specific Example, an electrophotographic printer as shown in FIG. 1 was constituted by using a photosensitive member 1 prepared by Photosensitive member Production Example 1 and a charging member 2 including magnetic particles 2*a* prepared in Magnetic particle Production Example 1 and used for successive image formation at a process speed of 24 mm/sec in an environment of 23° C. and 65%RH.

More specifically, the charging member 2 comprised magnetic particles 2*a* prepared in Magnetic particle Production Example 1, which were caused to form a magnetic brush with erected ears on a non-magnetic sleeve 2*b* formed under a magnetic field given by a magnet roller 2*c* enclosed within the sleeve 2*b*. The magnetic particles 2*a* were applied in an initial thickness of ca. 1 mm so as to form a magnetic brush forming a contact nip in a width of ca. 5 mm with the photosensitive member 1. The magnetic particle-holding sleeve 2*b* was initially disposed with a gap of ca. 500 μm from the photosensitive member 1. The magnetic roller 2*c* was held immovably within the sleeve 2*b*, and the sleeve surface was caused to move at a speed two times the peripheral speed and in a reverse direction with the rotation of the photosensitive member 1, so as to cause a uniform contact between the photosensitive member 1 and the magnetic brush 2*a*.

Incidentally, in case where no difference in peripheral speed is provided between the magnetic brush and the photosensitive member, the magnetic brush is liable to fail to retain an appropriate nip, thus resulting in charging failure, at the time of circumferential or axial deviation pushing the magnetic brush away, since the magnetic brush per se lacks a physical restoration force. For this reason, it is preferred that the magnetic brush is always pushed against the photosensitive member with its fresh surface. Accordingly, in this Example, the magnetic brush-holding sleeve 2*b* was rotated at a speed two time that of and in a reverse direction with the photosensitive member 1.

The image formation was performed in the following manner.

The charging member 2 supplied with a DC voltage of −700 volts was caused to contact the photosensitive member 1 with its magnetic brush 2*a* while rotating relative to the photosensitive member 1, thereby surface-charging the photosensitive member 1. Then, at an exposure position, the charged photosensitive member 1 was exposed to imagewise scanning laser light 3 from a laser diode subjected to intensity modulation based on given image signals with the aid of a polygonal mirror, thereby forming an electrostatic latent image on the photosensitive member 1.

Then, the electrostatic latent image formed on the photosensitive member 1 was subjected to reversal development with a magnetic one-component insulating toner produced in Toner Production Example above applied on a non-magnetic sleeve 4 of 16 mm in diameter enclosing a magnet therein. The sleeve 4 was disposed to have a fixed gap of 300 μm from the photosensitive member at the developing position and rotated at an equal peripheral speed. The sleeve 4 was supplied with a DC bias voltage of −500 volts superposed with a rectangular AC voltage with a peak-to-peak voltage of 1600 volts and a frequency of 1800 Hz, so as to effect a jumping development between the sleeve and the photosensitive member.

The thus developed toner image was then transferred to plain paper 6 by using a transfer roller 5 having a medium resistance of $5\times10^8$ ohm and supplied with a DC voltage of +2000 volts.

The plain paper sheet 6 carrying the transferred toner image was then passed between hot fixing rollers 8 to fix the toner image onto the paper sheet, and the sheet carrying the fixed image was discharged out of the apparatus. Residual toner not transferred to the paper 6 and remaining on the photosensitive member 1 was then scraped off the photosensitive member surface by a cleaning blade 7, and the cleaned photosensitive member surface was prepared for a subsequent cycle of image formation.

Furthermore, in the present invention, plural members among the above-mentioned photosensitive member 1, charging member 2, developing means including the sleeve 4 and cleaning means 7 can be integrally supported to form a process cartridge, which is detachably mountable to a main body of an electrophotographic apparatus, such as a copying machine, a laser beam printer and a facsimile apparatus. For example, at least one of the charging means 2, developing means 4 and cleaning means 7 can be integrally supported with the photosensitive member 1 to form a cartridge, which can be attached to and released from an apparatus main body with the aid of a guide means, such as a guide rail provided in the apparatus main body.

Incidentally, it is to be understand that the above-mentioned structure and process conditions have been set forth as a mere example and can be modified within the scope of the present invention.

In this particular Example, as a result of image formation by using a printer of the above-described structure, the photosensitive member 1 initially having a surface potential of 0 volt was charged up to −680 volts by once passing through the contact nip with the magnetic brush under application of a DC voltage of −700 volts to the sleeve 2*b*, thus showing a good charging performance. At this time, even when pinholes occurred on the photosensitive member, the current leakage did not occur. Further, the attachment of magnetic particles constituting the magnetic brush 2*a* did not occur, whereby good solid black and solid white images could be obtained. Further, even after 1000 sheets of successive image formation, the charging performance was similar to that in the initial stage, whereby good solid black and solid white images could be obtained. The image evaluation was performed with eyes.

Further, in the reversal development, the transfer charging polarity is opposite to the surface potential polarity on the photosensitive member, so that the potential history on the photosensitive member affects the charging performance in a subsequent cycle. In order to evaluate the phenomenon, in this Example, an A4-size longitudinal original image including a solid black image (having a low potential as an absolute value) in a width of ca. 94 mm (corresponding to one peripheral length of the 30 mm.dia. photosensitive member) and also a subsequent solid white image (having a high potential as an absolute value) was used to evaluate a fog in the solid white image (evaluation of charging ghost). In the charging ghost evaluation, a solid white image following a solid black image according to the reversal development scheme is liable to be accompanied with fog due to an insufficient increase in potential for providing the solid white image, unless the charging member exhibits a good charging performance. In this Example, however, no fog was observed during the successive reproductions of the above-mentioned original image including the solid black and solid white images.

EXAMPLE 2

Image formation and evaluation were performed in the same manner as in Example 1 except that the magnetic particles prepared in Magnetic particle Production Example 2 were used. As a result of 1000 sheets of successive image formation, the charging performance was similar to that in the initial stage, whereby good solid black and solid white images could be obtained.

EXAMPLE 3

Image formation and evaluation were performed in the same manner as in Example 1 except that the magnetic particles prepared in Magnetic particle Production Example 3 were used. As a result of 1000 sheets of successive image formation, the charging performance was similar to that in the initial stage, whereby good solid black and solid white images could be obtained.

EXAMPLE 4 AND 5

Image formation and evaluation were performed in the same manner as in Example 1 except that the magnetic particles prepared in Magnetic particle Production Examples 4 and 5, respectively, and the photosensitive member prepared in Photosensitive member Production Example 2 were used. As a result of 1000 sheets of successive image formation, good solid black and solid white images could be obtained, while the solid white images were accompanied with slight fog at a level of practically no problem due to a slight charging insufficiency caused by a decrease in contact nip in the charging ghost evaluation.

EXAMPLE 6

Image formation and evaluation were performed in the same manner as in Example 1 except for using the magnetic particles prepared in Magnetic particle Production Example 6. As a result, the performances were good at the initial stage but, after 1000 sheets of successive image formation, solid white images were accompanied with slight fog at a level of practically no problem in the charging ghost evaluation due to slight charging insufficiency.

EXAMPLE 7

Image formation and evaluation were performed in the same manner as in Example 1 except for using the magnetic particles prepared in Magnetic particle Production Example 9 and the photosensitive member prepared in Photosensitive member Production Example 4 and changing the applied voltage to −1250 volts, whereby good solid black and solid white images could be formed from the initial stage up to 1000 sheets of successive image formation.

EXAMPLE 8

Image formation and evaluation were performed in the same manner as in Example 1 except that the magnetic particles prepared in Magnetic particle Production Example 10 were used. As a result of 1000 sheets of successive image formation, the charging performance was similar to that in the initial stage, whereby good solid black and solid white images could be obtained.

Comparative Example 1

Image formation and evaluation were performed in the same manner as in Example 1 except that magnetic particles prepared in Magnetic particle Production Example 7 were used. As a result, from the initial stage, poor images occurred (solid white images were accompanied with fog) due to charging failure.

Comparative Example 2

Image formation and evaluation were performed in the same manner as in Example 1 except that magnetic particles prepared in Magnetic particle Production Example 8 were used. As a result, from the initial stage, solid white images were accompanied with black spots caused by partial charging failure due to pinhole leakage.

Comparative Example 3

Image formation and evaluation were performed in the same manner as in Example 1 except that the photosensitive member prepared in Photosensitive member Production Example 3 was used. As a result, from the initial stage, solid white images were accompanied with black spots caused by partial charging failure due to pinhole leakage.

What is claimed is:

1. An electrophotographic apparatus, comprising:

an electrophotographic photosensitive member, and (i) charging means, (ii) imagewise exposure means and (iii) developing means, said (i), (ii) and (iii) disposed in this order opposite to the photosensitive member, wherein said charging means includes a charging member comprising magnetic particles and disposed contactable to the photosensitive member so as to charge the photosensitive member based on a voltage received thereby, said photosensitive member has a surface layer comprising a charge injection layer, said charge injection layer containing lubricant particles and having a volume resistivity of $1\times10^{10}$ to $5\times10^{12}$ ohm.cm, and the magnetic particles comprise a ferrite component represented by the following formula (1):

$$(Fe_2O_3)_X(A)_Y(B)_Z \quad (1),$$

wherein A is MnO, B denotes at least one metal oxide component selected from the group consisting of $Na_2O$, $K_2O$ and SrO; X, Y and Z denote numbers representing mol ratios and satisfying the following conditions: $0.2<X<0.95$, $0.01<Y<0.5$, $X+Y<1$, $Y>Z$ and $0.02\leqq Z\leqq 0.08$.

2. An apparatus according to claim 1, wherein the magnetic particles have an average particle size of 5–100 $\mu$m.

3. An apparatus according to claim 1, wherein the magnetic particles have a volume resistivity of $1\times10^{4}$–$1\times10^{9}$ ohm.cm.

4. An apparatus according to claim 1, wherein said photosensitive member being chargeable to a surface potential of at least 90% of a DC voltage supplied to said charging member, said charging member comprising said magnetic particles arranged as a magnetic brush.

5. An image forming method, comprising the steps of:

charging an electrophotographic photosensitive member by applying a voltage to a charging member comprising magnetic particles and disposed in contact with the photosensitive member, imagewise exposing the charged photosensitive member to form an electrostatic image on the photosensitive member, said photosensitive member has a surface layer comprising a charge injection layer, said charge injection layer containing lubricant particles and having a volume resistivity of $1\times10^{10}$ to $5\times10^{12}$ ohm.cm, and developing the electrostatic image, wherein the magnetic particles comprise a ferrite component represented by the following formula (1):

$$(Fe_2O_3)_X(A)_Y(B)_Z \quad (1),$$

wherein A is MnO, B denotes at least one metal oxide component selected from the group consisting of $Na_2O$, $K_2O$ and SrO; X, Y and Z denote numbers representing mol ratios and satisfying the following conditions: $0.2<X<0.95$, $0.01<Y<0.5$, $X+Y<1$, $Y>Z$ and $0.02\leqq Z\leqq 0.08$.

6. A method according to claim 5, wherein the magnetic particles have an average particle size of 5–100 $\mu$m.

7. A method according to claim 5, wherein the magnetic particles have a volume resistivity of $1\times10^4$–$1\times10^9$ ohm.cm.

8. A method according to claim 5, wherein said photosensitive member is chargeable to a surface potential of at least 90% of a DC voltage supplied to said charging member, said charging member comprising said magnetic particles arranged as a magnetic brush.

* * * * *